US005875645A

United States Patent [19]

Dunnigan

[11] Patent Number: 5,875,645

[45] Date of Patent: Mar. 2, 1999

[54] SELF-SEALING VENDING MACHINE REFRIGERATION APPARATUS

[75] Inventor: David C. Dunnigan, Buffalo, Minn.

[73] Assignee: Gross-Given Manufacturing Company, St. Paul, Minn.

[21] Appl. No.: 835,702

[22] Filed: Apr. 10, 1997

[51] Int. Cl.[6] ..... F25D 19/02

[52] U.S. Cl. ..... 62/407; 62/302

[58] Field of Search ..... 62/448, 407, 337, 62/302, 298, 297, 237, 236; 312/116, 407, 407.1

[56] References Cited

U.S. PATENT DOCUMENTS

| | | | |
|---|---|---|---|
| 3,206,943 | 9/1965 | Rice et al. | 62/448 |
| 3,712,078 | 1/1973 | Maynard et al. | 62/448 |
| 4,776,182 | 10/1988 | Gidseg | 62/448 |
| 4,882,910 | 11/1989 | Meehan et al. | 62/256 |
| 5,417,081 | 5/1995 | Rudick et al. | 62/440 |
| 5,678,421 | 10/1997 | Maynard et al. | 62/407 |

FOREIGN PATENT DOCUMENTS

| | | | |
|---|---|---|---|
| 93008434 | 4/1993 | WIPO | 62/297 |

*Primary Examiner*—William Doerrler
*Attorney, Agent, or Firm*—Merchant, Gould, Smith, Edell, Welter & Schmidt

[57] ABSTRACT

An apparatus and method of installing a slide-in refrigeration unit in a vending machine that automatically aligns and seals the refrigeration unit air flow ducts to the refrigerated compartment of the vending machine, is disclosed. A simple assembly guides movement of the refrigeration unit as it is slid backward into the vending machine so as to identically align a pair of mating inclined surfaces of a duct connector assembly into sealing engagement, to automatically effect air flow communication between the refrigeration unit and the refrigerated compartment. The refrigeration unit installation is completed by simple securing the slid-in unit to the floor of the vending machine with several screws or bolts.

13 Claims, 5 Drawing Sheets

SELF-SEALING VENDING MACHINE REFRIGERATION APPARATUS

FIELD OF THE INVENTION

This invention relates generally to vending machines and more particularly to an improved refrigerated vending machine.

BACKGROUND OF THE INVENTION

Vending machines have become commonplace in today's societies. Depending upon the nature of the product(s) being dispensed or stored therein, such machines often require refrigeration systems to cool or provide freezing temperatures to all or a portion of the interior volume of the machine. Such refrigeration may be achieved by a number of techniques such as by common refrigeration units of the nature generally found in home refrigerators, by heat pumps, or the like. Such refrigeration units are typically mounted in the lower portion of the vending machine. Further since it is often difficult to move a vending machine for servicing, most vending machine refrigeration units are accessed through the front door or panel(s) of the machine.

It is important to be able to easily and rapidly service and maintain vending machines. Lost down time on the machine and excessive service/repair time rapidly deplete the revenues gained by the machine. Further, with regard to refrigeration units, it is important to rapidly complete the servicing in order to prevent possible spoilage or damage to the inventory/contents of the machine that may occur over extended servicing intervals. In the event of refrigeration unit failure, the most expedient service technique has typically been to remove and replace the entire refrigeration unit with an operable unit and to take the failed unit to a refrigeration expert for repair. However, removal and replacement of the refrigeration units in prior art vending machine configurations have been difficult and time-consuming operations.

The refrigeration units on most vending machines blow cooled air through an outlet duct of the refrigeration unit into a duct system or inlet of the vending machine cavity. In order to maximize cooling efficiency, it is important to create and maintain a tight seal between the refrigeration unit's outlet duct and the inlet duct system of the vending machine's cooled cavity. Prior art techniques have required cumbersome means for achieving the seal, making removal and replacement of a failed refrigeration unit a labor intensive and time consuming endeavor. For example, some systems require their refrigeration units to be laterally and longitudinally aligned with and positioned below the vending machine duct/inlet and then vertically lifted into and held in sealing engagement with the vending machine duct/inlet while appropriate fastening means, such as bolts we used to secure the unit in place. Besides the complexity of such operation, which can easily lead to damage of the seal members, the heavy weight of the refrigeration unit makes this operation all the more difficult. Others, require the entire vending machine to be pulled out from its normal operative position for removal of side panels to adequately access and service the refrigeration unit. In the case of a fully loaded beverage dispensing machine, this may also require unloading of the machine contents before it can be safely moved. If the vending machine is one that houses frozen or semi-frozen items, the removed items may require independent refrigeration or be susceptible to spoilage or damage. Still other vending machines use ductless refrigeration units that house the evaporator portion of the refrigeration unit directly inside the cooled chamber. In such configurations the evaporator unit is susceptible to direct damage from falling items in the cooled chamber. Further, such configurations require opening of the entire cooled chamber for repair or replacement of the evaporator unit, which can be a very difficult task.

The present invention addresses the prior art problems associated with the servicing of vending machine refrigeration units, by providing a vending machine refrigeration unit design that enables rapid, efficient and easy removal and replacement of the refrigeration unit in a manner that provides for self-alignment of air ducts and seals, minimizes seal damage, and provides for uniform and consistent correct placement of the refrigeration assembly relative to the vending machine, that provides for tight seals.

SUMMARY OF THE INVENTION

The present invention provides an apparatus and method for automatically self-aligning and sealing the air flow passageways between the refrigeration unit and the refrigerated chamber of a vending machine, while the refrigeration unit is being slid in only one lateral direction into the vending machine. No lifting of the refrigeration unit or tedious seal alignment operations are required. As the refrigeration unit is laterally slid or pushed into the vending machine compartment in which it will be housed, the air duct passageways leading from the evaporator portion of the refrigeration unit automatically self-aligns with and seals to the duct work of the vending machine which communicates with the refrigerated chamber of the machine. When the refrigeration unit is located in its operative position on the floor of the vending machine, it is simply secured in place to the floor by readily assessable and viewable mounting bolts.

According to one aspect of the invention there is provided a vending machine apparatus comprising:

(a) a chassis defining an internal cavity;

(b) a separator wall dividing the internal cavity into first and second chambers with the wall defining and inlet port therethrough, allowing fluid communication between the first and second chambers;

(c) refrigeration means for cooling air and for providing the cooled air to an outlet port of the refrigeration means;

(d) mounting means for mounting the refrigeration means in the second chamber; and (e) self-aligning duct means for aligning and operatively connecting the outlet and inlet ports; wherein the cold air passes from the refrigeration means, through the seal means and to the first chamber. According to a further aspect of the invention, the self-aligning duct means includes a pair of mating duct members and guide means which aligns and urges the pair of duct members into operative sealing engagement with one another as the refrigeration means is laterally moved in the second chamber. According to yet a further aspect of the invention, the pair of duct members include mating inclined seal surfaces.

According to a further aspect of the invention there is provided a method of providing an air flow seal between first and second chambers of a vending machine separated by a wall having an air passage port therethrough, comprising the steps of:

(a) providing the wall with a first seal member having a first seal surface mounted about the air passage port;

(b) providing a second seal member defining a second seal surface sized and configured to mate with the first seal surface;

(c) securing the second seal member to a source of refrigerated moving air; and (d) moving the source and the second seal means in a first lateral direction in the second chamber, causing the first and the second seal surfaces to sealingly engage.

DETAILED DESCRIPTION OF THE PREFERRED EMBODIMENT

Figure 1:
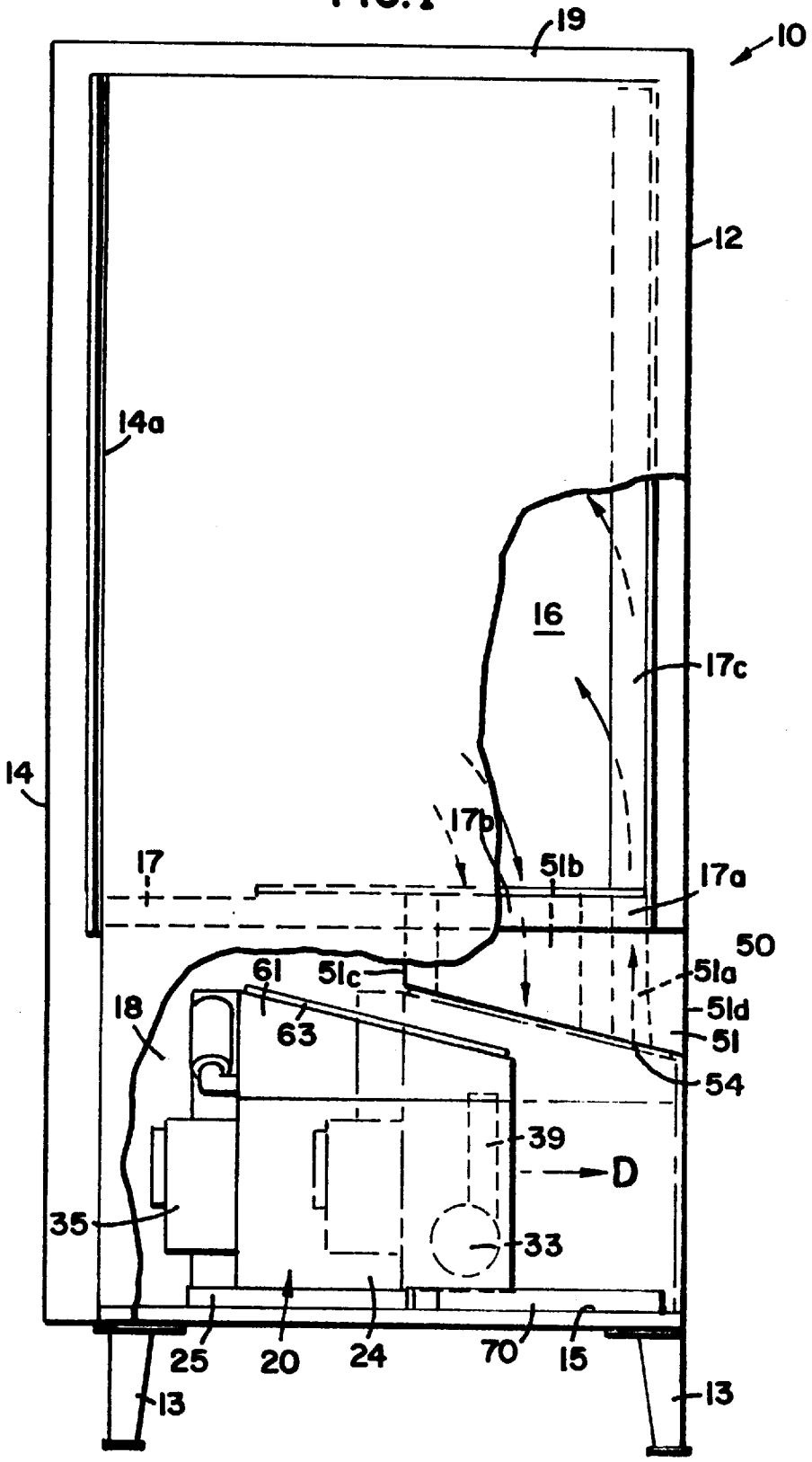
FIG. 1 is a view in side elevation, with portions thereof broken away, illustrating a vending machine of a preferred embodiment of the invention.

Referring to the Drawing, where unlike numerals represent like parts throughout the several views, a vending machine incorporating the principles of this invention is illustrated at 10 in FIG. 1. The vending machine 10 is a refrigerated type of machine designed for dispensing prepackaged food, beverage or other products that require refrigeration and/or freezing. The general nature and characteristics of such refrigerated vending machines are well-known in the art and will not be detailed herein except for the extent necessary for an understanding of the present invention.

Vending machine 10 generally includes a chassis 12 which encloses the top, bottom, back and opposed sides of the machine, and a front door assembly 14 that is pivotally mounted to the chassis 12. The chassis 12 may be supported in elevated manner upon a support surface by appropriate legs such as illustrated at 13 in FIG. 1. The door assembly 14 is normally locked in a closed position, as illustrated in FIG. 1 and defines with the chassis 12 one or more internal cavities of the vending machine. The front door assembly may include a multiple pane glass panel, illustrated at 14*a* which can be closed to selectively seal the upper compartment of the machine from exposure to the outside environment. Product selection, currency accepting and change providing mechanisms (not illustrated) are generally mounted within or on the front door assembly 14 for providing customer selection of products housed by the vending machine. The selected products are typically delivered to the customer through an appropriate delivery port or bin (also not shown), generally accessible through the front door of the machine. The vending machine 10 contains upper and lower internal cavities or chambers 16 and 18 respectively, separated by an internal wall or divider member 17. In the embodiment illustrated the walls defining the upper chamber refrigerated cavity 16, are insulated, as well as the relevant portions of the front door assembly 14, as generally shown at 19, to maintain the refrigerated ambient air temperature of the upper chamber. Also while not illustrated in the figures, it will be understood that appropriate shelving or other product containment means are mounted within the upper internal chamber 16, as well as appropriate mechanisms for effecting the vending of items held by such shelving or other product containment means, to the customer.

The lower cavity or chamber 18 of a refrigerated vending machine is typically configured to house the refrigeration unit of the machine. In the embodiment illustrated, the refrigeration unit is generally indicated at 20. A plurality of air passage ports or ducts are provided through the divider wall member 17, providing fluid or air communication between the upper and lower chambers of the vending machine. Such air ducts will be described in more detail hereinafter. The refrigerated air inlet duct through the divider wall for the upper internal chamber 16 is generally indicated at 17*a*; and the return duct for warm air from the upper internal chamber is generally indicated at 17*b*. In a preferred configuration of the refrigerated vending machine 10 illustrated in FIG. 1, the refrigerated air passing through the inlet duct 17*a* into the upper chamber 16 is vertically distributed throughout the upper chamber 16 through multiple perforations in a cold air supply duct panel, generally indicated at 17*c*, and vertically positioned along the back portion of the upper internal chamber 16.

Figure 2:
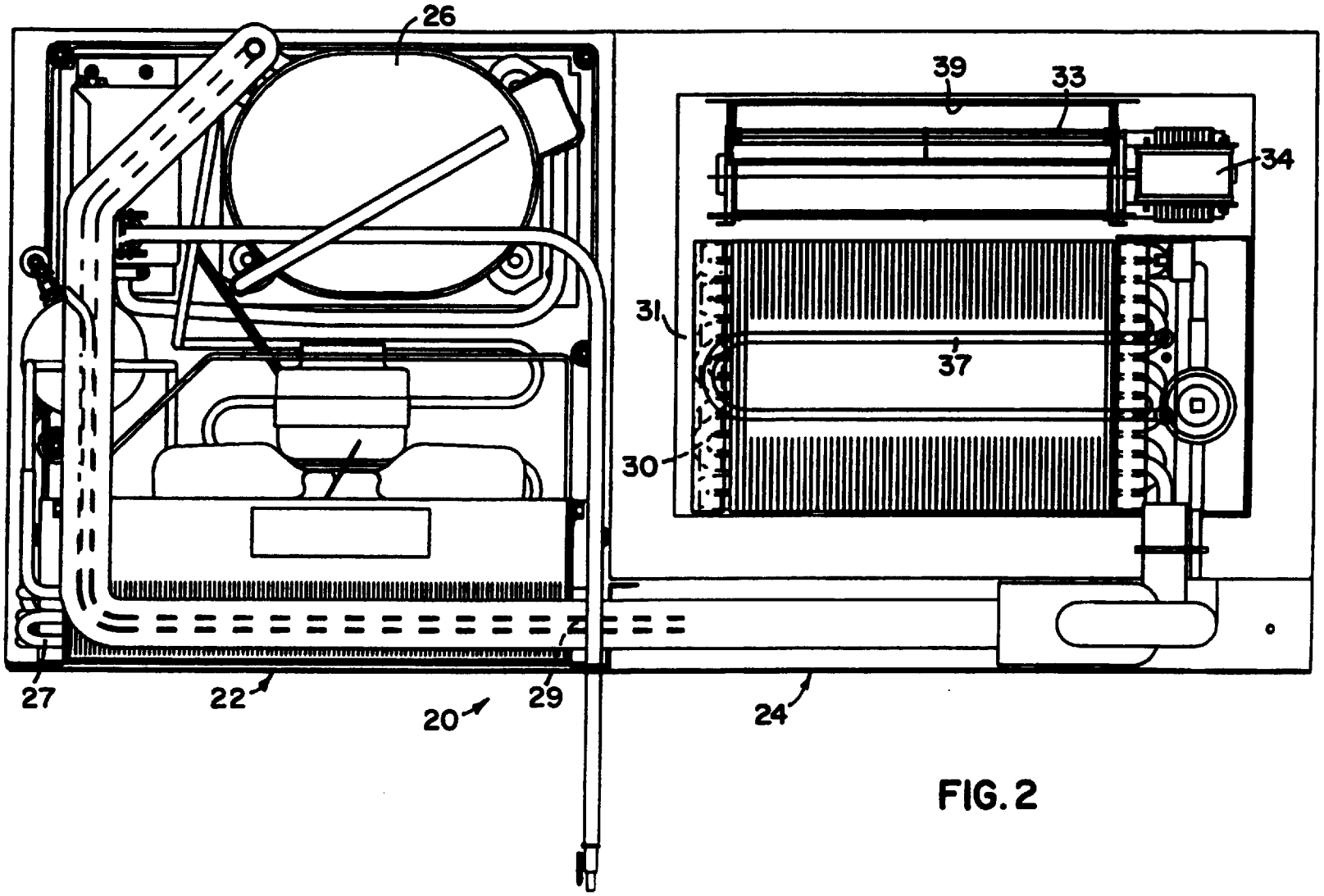
FIG. 2 is a top plan view with portions thereof removed, of the refrigeration unit portion of the vending machine disclosed in FIG. 1.
Figure 3:
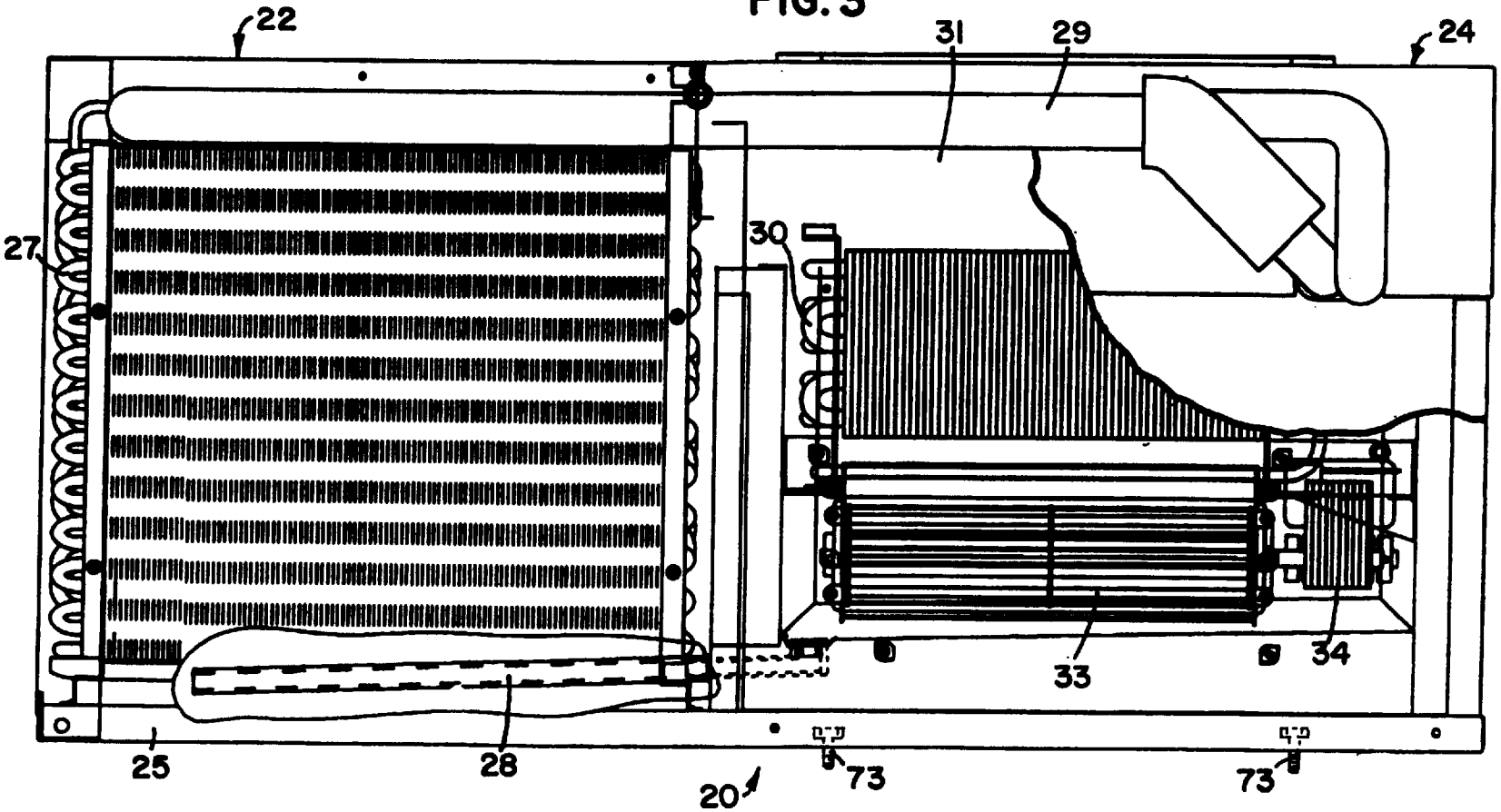
FIG. 3 is a fragmentary front elevation view of the refrigeration unit of FIG. 2 with portions thereof removed.
Figure 4:
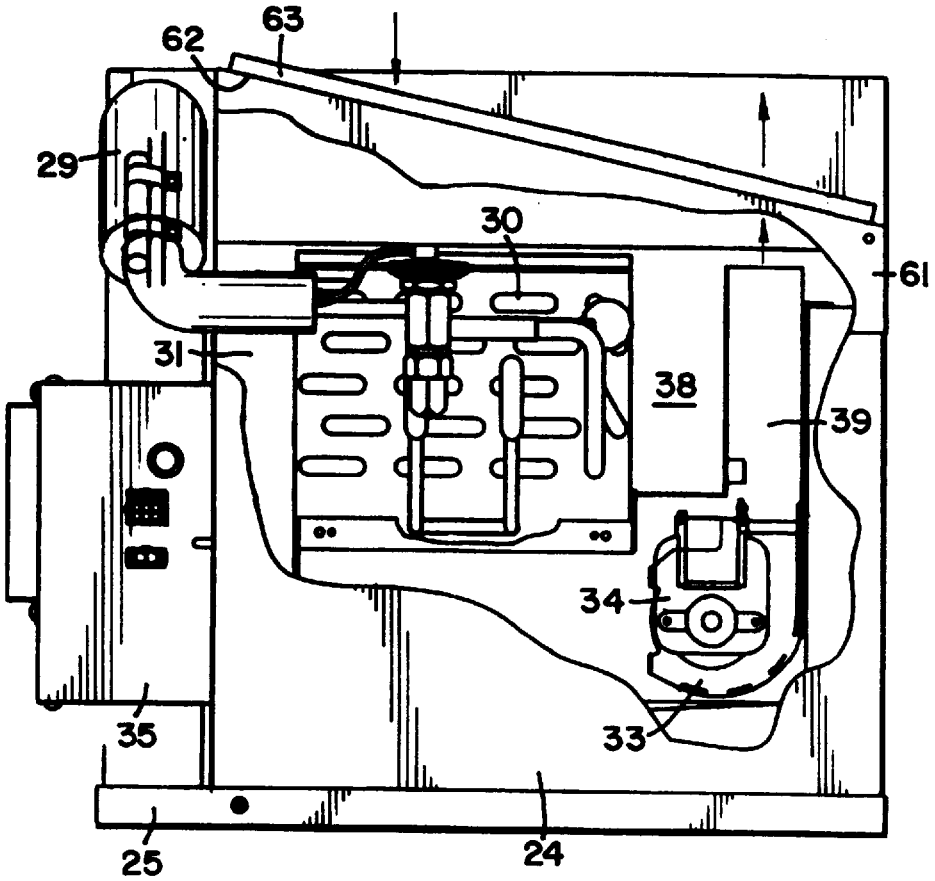
FIG. 4 is a fragmentary right side elevation view of the refrigeration unit of FIGS. 2 and 3.

The refrigeration unit 20 for a typical vending machine 10 is illustrated in more detail in FIGS. 2, 3, and 4. Referring thereto, FIG. 2 illustrates the refrigeration unit in top plan FIG. 3 illustrates the refrigeration unit in front elevation, and FIG. 4 illustrates the right side elevation of the refrigeration unit, with portions thereof broken away. Details of the refrigeration unit will not be given herein, except to the extent that portions thereof are relevant to a better understanding of this invention. As is known in the art, the purpose of the refrigeration unit 20 is to provide for and maintain cooling of the air being circulated within the refrigerated upper internal chamber 16 of the vending machine 10. It will be understood that the term refrigeration unit as used herein can refer to such units that are used to cool air in the 40° F. range as well as to units that can cool down to semifrozen levels of about 9° F. as well as to those used for frozen food applications that cool below −5° F. The refrigeration unit 20 generally includes two distinct portions comprising the condenser housing unit portion 22, illustrated at the left-hand portions of FIGS. 2 and 3, and the evaporator housing unit portion 24 illustrated at the right-hand portions of the FIGS. 2 and 3 illustrations. The condenser and evaporator housing units, while basically functionally separate, are physically mounted for common movement to a refrigeration unit frame or chassis member generally indicated at 25. The chassis 25 supports the components comprising the condenser and evaporator housing units for common movement and sliding motion, as hereinafter described in more detail, on the floor 15 (FIG. 1) of the lower internal chamber 18 of the vending machine 10. The condenser members of the condenser housing 22 are generally indicated at 26, and perform the standard function of refrigeration units in compressing the refrigerant within the closed system of the refrigeration unit, thereby cooling the refrigerant in the process. The condenser housing unit portion 22 of the refrigeration unit 20 has appropriate ventilation means in the lower internal chamber 18 (not illustrated) for allowing heat generated as a result of the condensing process to be expelled to the ambient air external of the vending machine 10. The refrigeration unit 20 illustrated in FIG. 2 is depicted with the upper covers and other ducting structures removed (to be described in more detail hereinafter) from the condenser and evaporator housing units 22 and 24 respectively. The heat dissipating coils of the condenser unit are generally illustrated at 27. The refrigerant is provided to the condenser coils by means of the refrigerant inlet tubing 28 and is returned from the condenser 26 to the evaporator portion of the refrigeration unit by means of the insulated cooled refrigerant line 29.

The evaporator housing unit portion 24 of the refrigeration unit assembly 20 is insulated by an appropriate insulation medium such as Styrofoam or the like and generally provides for heat exchange between the evaporator coils 30 and the air being provided to and circulated within the upper chamber 16 of the vending machine. The evaporator coils 30 receive condensed refrigerant from the condenser unit 22 by means of the cooled refrigerant line 29, and provide return flow to the condenser unit by means of the refrigerant return line 28. Heat exchange between the refrigerant in the evaporator coils 30 and the surrounding air taken from the upper chamber 16 takes place within an enclosed heat exchange cavity of the evaporator unit, generally indicated at 31. For facilitating the description, the front panel portions of the condenser and evaporator housing units 22 and 24 have been removed from the FIG. 3 illustrations. The heat exchange chamber 31 forms a continuous air duct passageway between the air return duct 17*b* (FIG. 1) and the refrigerated air inlet duct 17*a* of the upper internal chamber 16 (as hereinafter described in more detail). Directed air movement through the heat exchange chamber 31 of the evaporator unit 24 is achieved by means of a fan or a blower, generally indicated at 33, which is driven by a blower motor 34. Electrical control functions for the refrigeration unit 20 and for other related functions of the vending machine are provided by circuitry housed within a control unit, generally indicated at 35, which is in the preferred embodiment, mounted to the front panel of the evaporator unit housing 24. The evaporator unit 24 also includes an appropriate defroster heating element, generally indicated at 37 which enables periodic defrosting of the evaporator coils 30, which have a tendency to collect condensation that forms ice on the evaporator coils during operation of the refrigeration unit. The general operation of such refrigeration units is well-known in the art, and will not be detailed herein. Those skilled in the art will readily appreciate and understand the general principals of operation of such refrigeration units.

The heat exchange air chamber 31 of the evaporator unit 24 is divided and/or otherwise configured to direct air flow through the evaporator unit housing in a direction as indicated by the arrows in FIG. 4, from the warm air return duct 17*b* portion of the upper chamber 16 through the heat exchange chamber 31 and to the refrigerated air inlet duct 17*a* portion of the upper chamber 16. In the preferred embodiment, as illustrated in FIG. 4, such air movement control within the heat exchange chamber 31 is accomplished by means of a chamber divider wall member generally illustrated at 38 and an outlet air duct 39. Air entering the heat exchange chamber 31 through the warm air return duct 17*b* first passes through the evaporator coil 30 portion of the evaporator unit housing 24, and is pulled by the fan or blower 33 around the chamber wall divider 38 and directed into the outlet air duct 39, toward the refrigerated air inlet duct 17*a* of the upper chamber 16. A two-part self-sealing duct extension assembly completes the air transfer movement between the evaporator housing unit 24 and the upper chamber 16.

Figure 5:
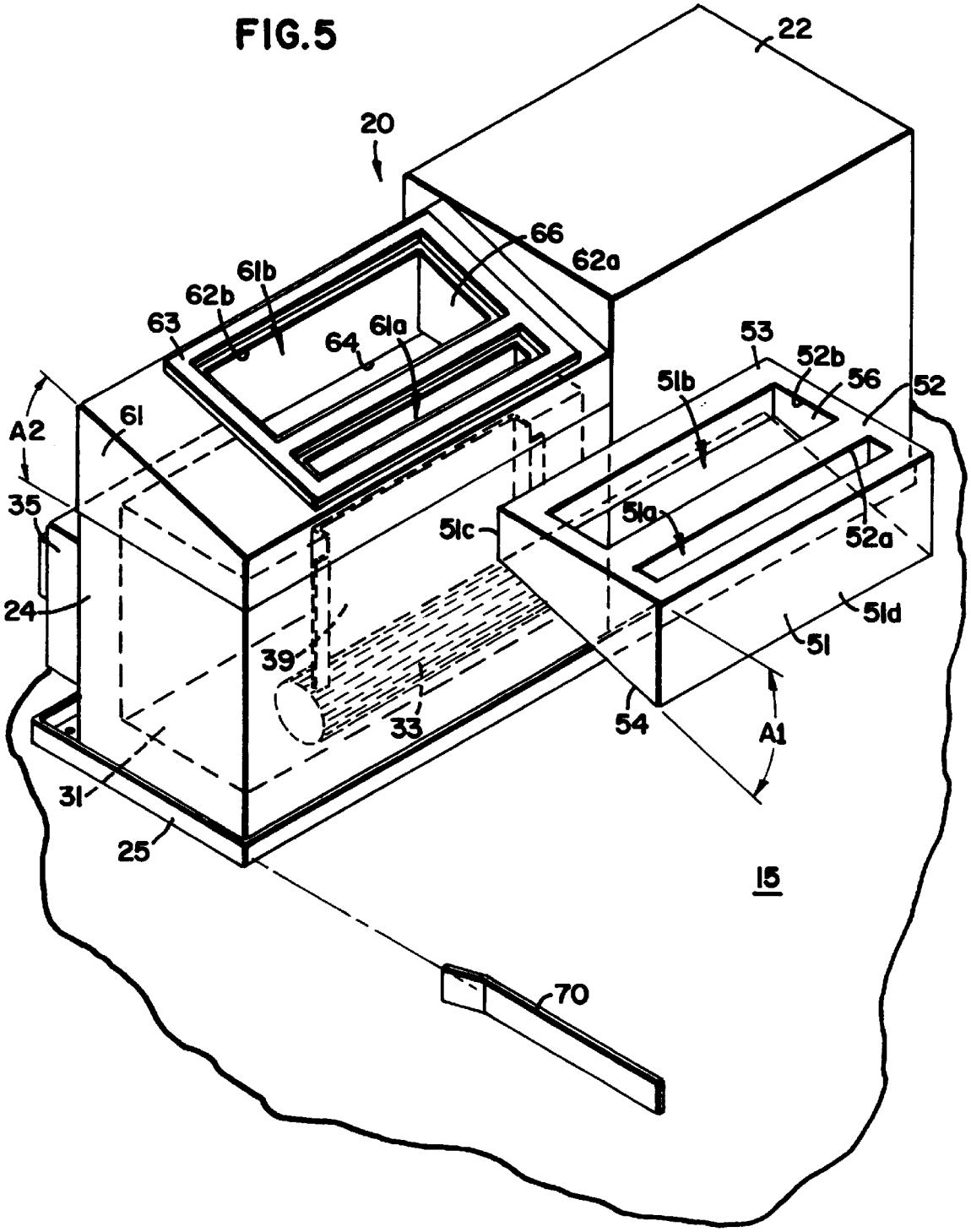
FIG. 5 is an enlarged perspective view of the refrigeration unit and self-sealing duct extension assembly portions of the vending machine disclosed in FIG. 1.

The two-part self-sealing duct extension assembly 50 is illustrated in more detail in FIG. 5. In the preferred embodiment, the outer shell portions of the duct extension assembly 50 are constructed of 18 gage steel. Referring thereto, an upper air duct housing portion 51 is configured for secure immovable attachment by fastening means (not illustrated) to the bottom of the divider wall 17 that separates the upper and lower chambers 16 and 18 respectively of the vending machine 10. The upper air duct housing 51 has, in the preferred embodiment, a top planar surface 52 defining first and second ports or openings therethrough 52*a* and 52*b* respectively, which are configured for cooperative alignment with the air inlet and air return ports 17*a* and 17*b* respectively in the divider wall 17 and provide air flow communication therebetween. A gasket seal member 53 is interposed between the upper planer surface 52 and the lower surface of the divider wall 17, to form an air-tight seal therebetween. The lower planer surface 54 of the upper air duct housing 51 is virtually a mirror image of the upper planar surface 52, having first and second ports 54*a* and 54*b* respectively that cooperatively align with and are spaced from the first and second ports 52*a* and 52*b* of the upper planer surface 52. A first upper duct housing passageway 51*a* formed through the upper duct housing 51 defines an air flow passageway between the first ports 52*a* and 54*a*. A second upper duct housing passageway 51*b* formed through the upper duct housing 51 forms an air flow passageway between the second ports 52*b* and 54*b* of the upper air duct housing. The sides of the first and second upper duct housing passageways 51*a* and 51*b* are lined with and formed by an insulating Styrofoam material 56. The lower planer surface 54 of the upper air duct housing is angularly disposed at an acute angle "A1" with respect to the upper planer surface 52 of the upper duct housing 51, with the angle of divergence therefrom extending from the forward edge 51*c* of the upper air duct housing 51 to the rearward edge 51*d* thereof. The lower planer surface 54 defines a first seat of the two-part self-sealing duct extension assembly 50 which cooperatively mates with the gasket material on the upper seat surface of the lower air duct housing assembly 61 of the two-part self-sealing external duct extension assembly, described below.

The lower air duct housing extension portion 61 is in the preferred embodiment, virtually a reverse shaped mating piece to the upper air duct housing 51 of the two-part self-sealing duct extension assembly 50, and is secured to the external chassis portion of the evaporator unit housing 24, as illustrated in FIG. 5, forming an operative extension thereof. The lower air duct housing 61 has an upper planer surface 62 defining first and second ports 62*a* and 62*b* respectively formed therethrough which are sized and configured to cooperatively and identically align with the first and second ports 54*a* and 54*b* respectively of the lower planer surface 54 of the upper air duct housing 51. First and second lower duct housing passageways 61*a* and 61*b* respectively are formed through the lower air duct housing 61 and are lined with insulative Styrofoam material 66 and terminate at first and second ports 64*a* and 64*b* respectively defined through the lower surface 64 of the lower air duct housing assembly 60. The first lower port 64*a* is aligned with and forms an operative extension of the outlet air duct 39 of the evaporator unit 24; and the second port 64*b* of the lower surface 64 opens into the air input portion of the heat exchange chamber 31 of the evaporator unit housing 24. As with the upper air duct housing 51, the upper planer surface 62 forms an acute angle "A2" with the lower surface 64 of the lower air duct housing 61 as illustrated in FIGS. 1 and 5. In the preferred embodiment angles A1 and A2 are the same. As illustrated in FIG. 1, when the refrigeration unit 20 is moved or slid into the lower internal chamber 18 of the vending machine (from front to back), the lower angled planer surface 54 and the upper angled planer surface 62 are angularly aligned to perfectly mate with one another in a manner such that when fully mated, the upper and lower air duct housings 51 and 61 of the duct extension assembly 50 operatively cooperatively define continuous extensions of one another. A sealing gasket material 63 is mounted on the seat surface 62 adjacent the first and second ports 62*a* and 62*b* of the lower air duct housing 61 as illustrated in FIG. 5, and is compressed between the upper and lower planer surfaces 62 and 52 respectively of the sealing duct assembly 50, to form an air-tight seal therebetween when the two portions of the duct extension assembly 50 are cooperatively and operatively mated as illustrated in phantom in FIG. 1. In the preferred embodiment, the gaskets 53 and 63 are constructed of closed cell PVC material with a density of 8 psi. The gaskets 53 and 63 are approximately ⅜ to ½ inch thick and one inch wide. It will be understood that the gasket material may be constructed from other appropriate sealing material as well, which will slightly deform while maintaining a seal under pressure. An appropriate gasket material (not illustrated) is also interposed between the lower surface 64 of the lower air duct housing 60 and the upper portions of the evaporator unit 24 adjacent the air inlet and outlet portions leading into the heat exchanger chamber 31.

A pair of linear guide members 70, one of which is illustrated in FIG. 5, are welded to the floor 15 of the vending machine chassis 12 in opposed manner and addressing the front or door opening portion of the machine, and are spaced apart in parallel manner at the exact distance corresponding to the lateral width of the lower chassis frame portion 25 of the refrigeration unit 20. The guides 70 serve to properly align the refrigeration unit 20 within the lower internal chamber 18 of the vending machine as the refrigeration unit is being slid backwards along the floor 15 and into operative position in the direction of the arrow "D" of FIG. 1. The guides ensure that the mating surfaces of the self-sealing duct extension assembly 50 will self-align and properly cooperative mate with one another to provide and air-tight seal therebetween when the refrigeration unit is simply slid back to its rearmost position within the lower internal chamber 18. The sealed mounting provides a continuous leak-proof air passageway from the air return duct 17*b* of the upper chamber 16, through the second passageways 51*b* and 61*b* of the duct assembly 50, through the heat exchange chamber 31 of the evaporator unit, through the outlet air duct 39 of the evaporator unit, through the first passageways 61*a* and 51*a* of the duct extension assembly 50 and through the refrigerated air inlet duct port 17*a*, back into the upper chamber 16. When the refrigeration unit 20 is thus properly slid into its sealing engagement position as just described, it can be rapidly held in place by simply aligning and inserting two securement bolts 72 (see FIG. 3) through the refrigeration unit lower support chassis 25 and into the floor 15 of the vending machine 10.

It can be appreciated that the entire refrigeration unit removal and replacement operations are accomplished by applying self-aligning forces to the refrigeration unit in one lateral direction (i.e. from front to back or conversely from back to front of the machine). It will also be appreciated that the linear sliding motion applied to the refrigeration during a replacement operation automatically translates to an orthogonal seal engaging force for effecting a tight seal through the duct extension assembly 50 as a result of the angled mating surfaces 54 and 62.

While the angle of the mating surfaces of the self-sealing duct extension assembly 50 may vary, a preferred range of the acute angles A1 and A2 is in the range of from about 10° to 20°. The angle used and illustrated for the preferred embodiment disclosed is approximately 12°. Considerations involved in selecting the particular angle to be used include the extent of sliding engagement desired between the sealing gasket material 63 and the lower surface 54 of the upper duct housing 51 and the desired amount of compression of the gasket material 63. Also, an increase in the angle changes the design constraints related to the sizes of the air passage access ports and passageways formed through the duct extension assembly.

Other modifications of the invention will be apparent to those skilled in the art in light of the foregoing description. This description is intended to provide specific examples of an embodiment which clearly discloses the present invention. Accordingly, the invention is not limited to the embodiments disclosed or to the use of any particular materials or specific shapes of parts presented herein. All alternative modifications and variations of the present invention which follows in the spirit and broad scope of the appended claims are included.

I claim:

1. A vending machine apparatus comprising:

A. a chassis defining an internal cavity;

B. a separator wall dividing said internal cavity into first and second chambers, said wall defining an inlet port therethrough, allowing fluid communication between said first and said second chambers;

C. a refrigeration unit to cool air and to provide said cooled air to an outlet port of said refrigeration unit;

D. mounting apparatus slidably mounting said refrigeration unit in said second chamber; and E. self-aligning duct members configured to align and operatively engage said outlet and inlet ports as said refrigeration unit moves in a lateral sliding direction relative to said chassis; said self-aligning duct members being configured to align and engage in directions that are not normal or perpendicular to said lateral sliding direction;

wherein said cooled air passes from said refrigeration unit through said duct members and to said first chamber.

2. The vending machine apparatus as recited in claim 1, wherein said self-aligning duct members comprise:

a. a first duct member fixedly secured to said separator wall about said inlet port;

b. a second duct member cooperatively matable with said first duct member and mounted to said refrigeration unit about said outlet port; and c. a guide engagable by said refrigeration unit to align and urge said first and said second duct members into operative sealing engagement with one another in said not normal or perpendicular directions as said refrigeration unit laterally moves in said second chamber.

3. A vending machine apparatus, comprising:

A. a chassis defining an internal cavity;

B. a separator wall dividing said internal cavity into first and second chambers, said wall defining an inlet port therethrough, allowing fluid communication between said first and said second chambers;

C. a refrigeration unit for cooling air and for providing said cooled air to an outlet port of said refrigeration unit;

D. mounting apparatus mounting said refrigeration unit in said second chamber; and E. self-aligning duct members aligning and operatively connecting said outlet and inlet ports, said self-aligning duct members comprising:

i. a first duct member fixedly secured to said separator wall about said inlet port, including a first inclined seal surface surrounding an air passageway of said first duct member;

ii. a second duct member cooperatively matable with said first duct member and mounted to said refrigeration unit about said outlet port, including a second inclined seal surface surrounding an air passageway of said second duct member; and iii. a guide engagable by said refrigeration unit aligning and urging said first and said second inclined surfaces of said first and said second duct members into operatively sealing engagement with one another as said refrigeration unit is laterally moved in said second chamber; wherein said cooled air passes from said refrigeration unit through said duct members and into said first chamber.

4. The vending machine apparatus as recited in claim 3, further including a seal member compressively engaged between said first and said second inclined surfaces.

5. The vending machine apparatus as recited in claim 3, wherein said refrigeration unit is mounted to a floor of said second chamber; and wherein said first and said second inclined seal surfaces form acute angles to the general plane of said floor.

6. The vending machine apparatus as recited in claim 5, wherein the acute angles of said first and said second inclined seal surfaces are substantially the same.

7. The vending machine apparatus as recited in claim 6, wherein the acute angles are in the range of about ten to twenty degrees.

8. The vending machine apparatus as recited in claim 1, wherein said refrigeration unit includes an evaporator unit; and wherein said self aligning duct members connect said evaporator unit with said first chamber.

9. The vending machine apparatus as recited in claim 3, wherein said first duct member includes insulative foam for forming said air passageway of said first duct member; and wherein said second duct member includes insulative foam for forming said air passageway of said second duct member.

10. A method of providing an air flow seal between first and second chambers of a vending machine separated by a wall having an air passage port therethrough, comprising the steps of:

a. providing said wall with a first seal member having a first seal surface mounted about said air passage port;

b. proving a second seal member defining a second seal surface sized and configured to mate with said first seal surface;

c. securing said second seal member to a source of refrigerated moving air; and d. moving said source and said second seal member in a first lateral direction in said second chamber, causing said first and said second seal surfaces to align and sealingly engage in directions that are not normal or perpendicular to said first lateral direction.

11. The method of claim 10, including the step of automatically aligning said first and said second seal surfaces as said source and said second seal means are moved in said first lateral direction.

12. The method of claim 10, wherein said source and said second seal member only move in said first lateral direction to cause said first and said second seal surfaces to align and sealingly engage.

13. The method of claim 10, wherein said first lateral direction is a horizontal direction.

* * * * *